United States Patent [19]

Thiers

[11] 4,261,661

[45] Apr. 14, 1981

[54] APPARATUS FOR PRODUCING DOUBLE SIDED COPIES

[75] Inventor: Christiaan G. Thiers, Schoten, Belgium

[73] Assignee: Agfa-Gevaert N.V., Mortsel, Belgium

[21] Appl. No.: 27,738

[22] Filed: Apr. 6, 1979

[30] Foreign Application Priority Data

Apr. 10, 1978 [GB] United Kingdom ..... 14004/78

[51] Int. Cl.[3] ..... G03G 15/22

[52] U.S. Cl. ..... 355/24; 355/3 SH; 355/14 SH; 355/25

[58] Field of Search ..... 355/3 SH, 14 SH, 11, 355/8, 23-26; 271/213

[56] References Cited

U.S. PATENT DOCUMENTS

| | | | |
|---|---|---|---|
| 3,630,607 | 12/1971 | Korn et al. | 355/14 R X |
| 3,963,345 | 6/1976 | Stemmle | 355/50 |
| 4,017,173 | 4/1977 | Komori et al. | 355/8 |
| 4,035,073 | 7/1977 | Del Vecchio | 355/24 |
| 4,077,714 | 3/1978 | Komori et al. | 355/8 X |
| 4,099,150 | 7/1978 | Connin | 355/23 X |
| 4,140,387 | 2/1979 | Gustafson | 355/14 SH |
| 4,154,524 | 5/1979 | Hattori et al. | 355/8 X |

OTHER PUBLICATIONS

*IBM Tech. Disc. Bull.*, "Sheet Stacking Technique", D. F. Manning et al., vol. 17, No. 8, Jan. 1975, p. 2255.

*Primary Examiner*—William H. Beha, Jr.
*Attorney, Agent, or Firm*—William J. Daniel

[57] ABSTRACT

Disclosed is a xerographic copying apparatus 10, by means of which a variety of copying modes may be realized. So, the apparatus enables the simultaneous production of double sided copies from double sided originals, of double sided copies from two single sided originals, and of single sided copies from double sided originals. The apparatus is so designed that the relative order of the originals as well as of the copies is maintained and that no reversing of the originals is necessary after exposure. The apparatus is so designed that collated sets of copies are obtained, although it may also be set to make multiple copies of one original.

10 Claims, 6 Drawing Figures

12
20
47
51
57a
57b
32R
32L
141
142

12
20
150
151
47
51
57a
57b
32R
32L
141
142

APPARATUS FOR PRODUCING DOUBLE SIDED COPIES

This invention relates to xerographic copying apparatus for making duplex xerographic copies, i.e. copies in which the copy sheets bear xerographic images on both sides.

Duplex xerographic copying apparatus is known wherein for a single exposure of a photoconductive element to graphic matter on one side of a master, a pre-selected number of xerographic copies of that matter is formed on a succession of copy sheets which enter a temporary storage facility and can be automatically fed back through the machine for receiving copies of further graphic matter on their reverse sides.

Xerographic copying apparatus has also been proposed which has provision for feeding duplex masters, i.e. master sheets bearing graphic matter on both sides, to an image projection station from which images of both sides of the master are projected to different areas of a photoconductive element, and for supplying copy sheets along forward and return paths during which front and rear sides of such copy sheet come successively into registration with said different areas of the photoconductive element for image transfer purposes, prior to delivery to a copy sheet collector. A succession of such duplex copies can be made by running a succession of copy sheets through the machine while the photoconductive element retains the photoconductive images.

Duplex copying can be used for copying graphic matter on one side of each of a succession of master sheets, as well as for reproducing duplex master sheets, i.e. master sheets printed on both sides.

Present day duplex xerographic copying apparatus show the inconvenience that in one or other stage of the reproduction process a sheet reversing action has to be carried out in order to preserve the order and sequence of the master sheets constituting the original. A same position-reversion has to be carried out with the copy sheets after that they are provided with a transferred image on one side.

The aforegoing precautionary measures increase the complexity and the cost price of a xerographic duplex copying apparatus. Moreover, supplementary complicated electronic systems, such as the so-called "job recovery program" are required in addition.

It is therefore an object of the invention to provide a xerographic duplex copying apparatus which is compact, simple in construction and in which the critical stage of reversing the position of master sheets as well as copy sheets is omitted. Moreover, a sorter as in indirect systems is not required.

According to the invention, there is provided: A xerographic copying apparatus which comprises an image projection station from which images of matter appearing on master sheets fed to that station are projected, copying means comprising a photoconductive element operative to successively record two images projected from said projection station; transfer and fixing means for causing copy sheets brought into image receiving relationship with such areas to receive and fix images in correspondence with images recorded on said areas of the photoconductive element, and means for conditioning said element for recording fresh images, which apparatus also incorporates:

a first master sheet handling mechanism adapted automatically to feed master sheets taken one by one in succession from a stack, from a master feeding station to the said image projection station and to a master collecting station in such a manner that the successive master sheets collect at that station in the reverse order as they had in said feeding station, so producing a first set of records of said master sheets, a second master sheet handling mechanism adapted automatically to feed master sheets one by one in succession from said stack collecting station to said image projection station and to said master feeding station again in such a manner that the successive master sheets collect at that station in the reverse order as they had in said collecting station, so producing a second set of records of said master sheets, a copy sheet handling mechanism adapted automatically to remove copy sheets one by one in succession from a stack and bring first one side and then the other side of such sheet in image-receiving relationship with said different areas of the photoconductive element in such a way that copy sheets bearing an image of master sheets fed by said first master sheet handling mechanism are fed towards a first collecting location so that successive copy sheets collect at that location in the same sequence the master sheets had in the stack at the master collecting station and that copy sheets bearing an image of master sheets fed by said second master sheet handling mechanism are fed towards a second collecting location so that successive copy sheets collect at that location in the same sequence the master sheets had in the stack at the master feeding station.

When using this apparatus for copying a stack of loose master sheets, e.g. sheets composing a document to be copied, the stack of master sheets is retrievable immediately after a copying run with the master sheets in the correct orientation. Likewise a copy in duplex form and having its pages in the same sequence as the copied master pages can be immediately retrieved. For making duplicated duplex copies of a document, the copying run is simply repeated the required number of times. Each of the duplex copies of the document are immediately available with their pages in correct sequence. Laborious collation of copy sheets after the copying runs is avoided without recourse to complicated collating mechanism operative during such runs.

In order to ensure that when making two or more duplex copies of a document they are delivered by the apparatus in already collated condition, the apparatus is preferably constructed so that during automatic master sheet feeding the apparatus functions are synchronised so that each pair of projected images recorded on the photoconductive element is used for image transfer onto one copy sheet only before such element is conditioned for recording two fresh projected images deriving from a succeeding duplex master sheet or from one side of each of two succeeding master sheets.

The apparatus can include a setting mechanism by which the apparatus can be set to repeat a complete copying run one or more times to produce a required number of complete duplex copies of a document.

In preferred embodiments of the invention the apparatus is capable of making duplex copies of duplex master sheets. The apparatus has means for projecting images of matter appearing on the opposed sides of a duplex master sheet onto the said different areas of the photoconductive element during one cycle of the master sheet handling mechanism. When making duplex copies of duplex master sheets composing a document, the apparatus functions are synchronised so that each of the operations of feeding a master sheet to the image projection station, projecting a pair of images to the photoconductive recording element, transferring the recorded images to opposite sides of a copy sheet and conditioning of the photoconductive element, occurs once for each cycle of the copy sheet handling mechanism.

Apparatus according to the invention preferably incorporates image projection means which scans the matter to be copied as the master sheet moves through an image projection station.

Apparatus according to the invention and designed for copying duplex master sheets, is preferably constructed so that images of the matter on the opposed sides of a master sheet are projected in sequence and the photoconductive element is displaced during the image projection phase so as to bring the different recording areas thereof successively into image receiving position. Preferably an image of the matter on one side of the master sheet is progressively projected to the photoconductive element during displacement of the master sheet in one direction and the master sheet handling mechanism then causes a reverse displacement of such sheet and an image of the matter on the opposite side of that sheet is progressively projected during that reverse movement.

The apparatus may comprise an optical projection system incorporating at least one objective which serves in the projection of images from both sides of a duplex master sheet, the objective being movable automatically from one operative position to another in timed relation to the successive illumination phases wherein first one and then the opposite side of a duplex master sheet is illuminated. The objective movements can be governed by means which controls or is controlled by termination of one illumination phase.

The photoconductive element may be in the form of a drum or belt. The drum may have a periphery enabling the registration of two latent images in one turn, or one of smaller diameter having another angular speed and onto which only one latent image may be provided.

The copying means can operate according to a well known principle involving overall electrostatic charging of the recording areas of the photoconductive element and development of the latent electrostatic images resulting from the image-wise irradiation of such areas with light from the projection station, and the transfer means may cause image-wise transfer of developer from the photoconductive element to the copy sheet. The transfer means may alternatively be constructed so that the electrostatic latent images borne by the photoconductive element are used to induce an electrostatic image in the copy sheet. (Such an inducement is regarded for the purposes of this specification as an image transfer). The apparatus will in such circumstances incorporate means for directly developing the induced electrostatic images on the copy sheet. As a further alternative the copying and transfer means may be constructed so that image-wise irradiation of the photoconductive element creates conductively images which are then converted to electrostatic images prior to development and transfer, or prior to transfer and then to development, or which are used in conjunction with electrostatic charging means to create electrostatic charge images directly in the copy sheet.

The xerographic copying apparatus will in any event normally be provided with means causing fixing of the visible images produced on the copy sheets.

Apparatus according to the invention may incorporate a supplementary projection station, of a kind known in the art as a "book-copier". Such station may comprise a glass platen on which an opened book can be placed with its pages facing the platen. An apparatus having such a supplementary projection station may be equipped with a scanning projection system for progressively projecting images of the two book pages during one copying cycle. Switching from sheet copying to book copying mode can automatically effect any movement of optical elements, e.g. mirrors, or lenses, which may be necessary. Advantageously the optical projection system of the apparatus includes at least one objective which functions during both of said copying modes, the objective being moved automatically into the appropriate operative position when the apparatus is switched from one copying mode to the other.

Certain embodiments of the invention, selected by way of example, will now be described with reference to the accompanying diagrammatic drawings, in which.

Figure 1:
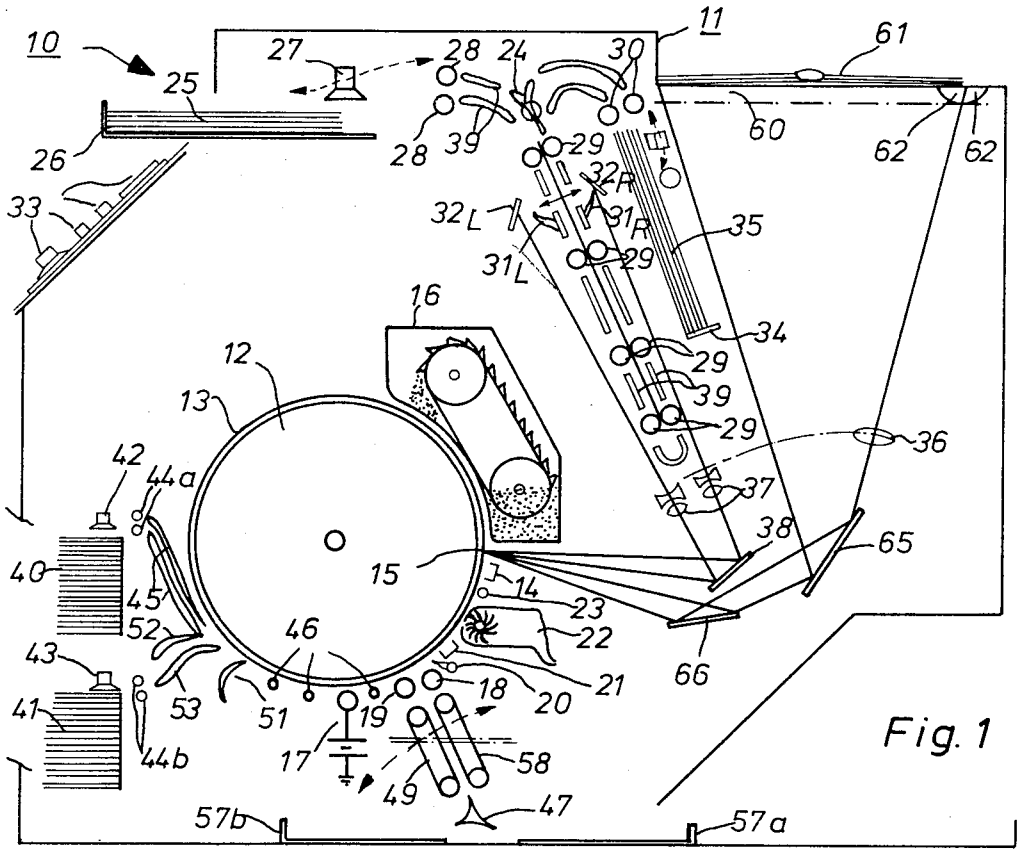
FIG. 1 shows a cross-sectional view of copying apparatus according to the invention.

The apparatus 10 according to the invention, comprises a housing 11 in which the different parts are located.

The parts, designated for the xerographic copying cycle which are located in the housing 11 comprise a drum 12 onto which a layer of photoconductive material 13, such as amorphous selenium is fitted. The drum 12 is continuously driven by motor means (not shown). A charging corona device 14 deposits a uniform electrostatic charge on the surface of the conductive layer 13, which charge is selectively dissipated during exposure at exposure station 15 in response to the amount of light which strikes the concerned area of the photoconductive layer 13. The charge remaining at the surface of the conductive layer 13 after exposure thereof, constitutes the latent electrostatic image which is rendered visible at developing station 16. Developing station 16, here represented as a cascade type device, makes the latent electrostatic image contact coloured particles known as toner having an electric charge opposite to that of the charge remaining on the photoconductive layer 13 and which, in consequence are attached thereto by said charge. The drum 12, now bearing a visible toner image meets transfer roller 17 and a sheet of copy paper is forwarded in the nip formed by the drum 12 and transfer roller 17. The latter is brought at a high DC-voltage which is of sufficient magnitude to attract the toner image, which is intercepted by the sheet of copy paper lying in between. As a consequence the sheet of copy paper now bears the toner image, which adheres only loosely to it. Therefore, a fixing cycle is necessary. This cycle is carried out at the fixing station, here represented by rollers 18 and 19. Roller 18 contacting the toner image on the copy sheet may be an internally heated cylinder onto which a layer of toner repelling material is provided. Roller 19 is a pressure roller which may be a solid cylinder in a material showing a sufficiently high rigidity in order to prevent any deformation under the pressure applied and onto which also a coating or sleeve of toner repelling material may be provided, if necessary. As a consequence of the simultaneous application of heat and pressure, the toner of which one of its constituents is a resinous compound, acquires a more or less molten state so that it becomes capable to form a firm bond with the fibres of the copy paper.

As may be derived from the figure, the copy paper which is to be forwarded towards the fixing station has to be loosened from the drum 12. In order to guarantee that the paper does not remain adhering to the surface of the drum 12, an air knife 20 or other suitable means known in the art is used for detaching the paper from the photoconductive surface.

It may be presumed that after exposure and transfer of the toner some charge remains at the photoconductive surface 13 of drum 12.

The photoconductive surface 13 of drum 12 therefore passes in front of an AC-corona 21 which restores its zero-charge condition, whereas residual toner which might still adhere to the surface 13 is eliminated at a cleaning station 22 which comprises a brush rotating in a direction opposite to that of drum 12, which brush may be mounted in a housing connected to a vacuum source (not shown). In order to guarantee optimum conditions for a next copying cycle, the photoconductive surface 13 is struck with an overall exposure by means of lamp 23.

It will be clear that instead of the illustrated and described constituent stations of the xerographic part of the apparatus according to the invention, their equivalents may be used with the same reliability. So the cascade type developing station 16 may be replaced by a magnetic brush developing station; the transfer roller 17 may be replaced by a transfer corona and instead of the fixing station 18, 19 of the roller type, a heated platen, radiant heaters or flash fixing units may be used, etc.

The exposure of originals 25 stacked on a platform 26 occurs as follows. A vacuum suction member 27, or any other means capable of taking hold of a sheetlike object, seizes the front edge of the uppermost one of a stack of originals 25 and feeds them into the nip of a pair of transport rollers 28 and via guides, which in the exposure station will all be denoted by the numeral 39, and a plurality of transport roller pairs 29 in front of an illumination station comprising light sources 31L and 31R and associated mirrors 32L and 32R. During its movement in front of the light sources 31, the original 25 is scanned and the reflected image is forwarded to the exposure station 15 via mirrors 32 and 38 and lens 36 (see trajectory). In order to compensate focus variations when copying in book mode (see further) auxiliary lenses 37 may be provided. If required, the guides 39 and rollers 29 may be replaced by endless belts.

Scanning of an original 25 occurs in sequence, that is to say that both faces of the original are scanned one after another. So during the downward movement of the uppermost original of stack 25 in front of the light sources 31, the back face is scanned whereas during the return in upward direction the front face of the uppermost original is scanned. It will be clear that during the second cycle the sense of rotation of the transport rollers 29 must be reversed. This may be carried out with the help of, for example, a microswitch (not shown) located at the downmost end of the original's trajectory, whereby the leading edge of said original actuates the moving arm of said microswitch. After the scanning of both sides of the original 25 has finished the original follows in part its original trajectory until a protruding portion of movable guide member 24 is reached. There, the leading edge of the original 25 is deviated and the latter is forwarded to transport roller pair 30. There, the original is forced towards the bottom of tray 34, where it is collected, thereby forming the stack 35, with the other originals after copying.

It will be clear that the manner of feeding the originals as described above results in a reverse stacking of the letters, in that the original which was the uppermost one in tray 26, becomes the downmost one in tray 34, and, alternatively, that the one located downmost in tray 26 becomes the uppermost one in tray 34 after one complete copying cycle. The relative position of the faces of the originals, however, has remained the same, and after a second copying run—now from tray 34 towards tray 26 via the exposure station—the originals are again collected in their original order (see further).

It will also become clear in the further course of the description that this way of copying has definite advantages in comparison with prior art devices where extreme care must be taken for not disturbing the original sequence of the originals and in which, as a consequence, an automatic feeder and a temporary sheet storage of complicated design has to be provided.

At some predetermined moment, which depends on the peripheral speed of the drum 12, now bearing two images after development at developing station 16, suction member 42 resp. 43 picks up a sheet of copy paper from the stack 40, resp. 41 and guides it via transport roller pair **44*a* resp. 44*b* into guides 45, 46 resp. 52, 53 where they emerge in close vicinity of the drum 12. Due to the deviating action of the rotating drum 12, the copy paper is firmly pressed against the latter through the intermediary of pressure rollers 46. Meanwhile, the toner image made from the face of the original which was first exposed is transferred to the first face of the copy paper at transfer station 17. When leaving the surface of the drum 12, thereby helped by air knife 20, the copy sheet is transferred for a first time towards the fixing station 18, 19. Immediately after fixing the copy sheet is gripped in the nip of a pair of endless belts 49, 59 which step after that the copy sheet has fully left the fixing station 18, 19. The endless belts are capable of performing a partial rotation in a sense indicated by the arrow in dash lines and of reverse rotating so that the copy sheet may once again be fed towards the drum 12 via guide shell 51** in order to undergo a second copying cycle.

This time, however, the copy sheet—now bearing a fixed image on either face of it—fully emerges from the endless belt and is diverted by means of diverting element 47, towards tray **57*b***.

When copying in reverse order—i.e. when feeding originals from tray 34 towards tray 26—copy sheets are diverted to tray **57*a***.

Further details of a complete copying cycle is explained further.

It will be clear that instead of two stacks 40 and 41 of copy paper, use may also be made of rolls of copy paper from which suitable lengths may be cut by means of some cutting mechanism.

The two stacks 40 and 41 suit merely the purpose of illustrating that, if desired, different kinds of paper may be used for copying purposes.

If required, the apparatus 10 may also comprise, in addition, an exposure frame 60 onto which an opened book 61 with pages faced downwards may be positioned. Light sources 62 make a reciprocating motion under the exposure frame 60 according to the trajectory indicated in dot-and-dash lines and the lens 36, now in the book copying position, projects the image of the pages concerned onto the exposure station 15 via mirrors 65 and 66. It will be clear that instead of two separate mirrors, a roof-shaped mirror may be used with the same advantage. After exposure, the apparatus is operated in the same manner as for the duplex/duplex sheet copying mode. From FIG. 1, it may also be derived that additional objectives 37 may be provided. They are not necessary, however, when the focal distance of exposure frame 60 is equal to that of the scanning exposure station for sheet copying. In order to get a book-shape aspect of the copies taken from books, a book-copying cycle will start at the central part of the exposure frame 60, where two succeeding pages of the book meet. In the meantime, sufficient time is provided for performing a first transfer step. Then the page is turned and scanned from the edge towards the middle, where the light source 62 starts a new copying cycle intended to proceed to the printing of said page to another sheet of copying paper.

Switching from one mode to the other may be done by the operator of the apparatus or automatically.

In the latter case, pressure sensitive detectors may be provided under the exposure frame 61 which may be resiliently mounted in that case. The weight of a book 61 will be sufficient to slightly push the frame in downward direction, thereby activating the switching system for changing the copying mode.

During the time that the first copying cycle has come to an end and the second one starts, the charging corona 14 is kept in cut-off condition in order to avoid the formation of a uniform high density area between the areas of the photoconductive surface 13 where the latent image of the originals are formed. Indeed, when the corona 14 would be continuously operating the absence of an image pattern would give rise to an area on the photoconductive surface 13 on which the uniform initial charge would remain so that a band of high density toner deposit would result after passage of the concerned area through the developing station 16.

Finally, on the front of the housing 11 a plurality of other expedients 33, such as switches, knobs, lamps or meters may be provided in order to raise the ergonomic properties of the apparatus and which may be used to indicate or set the number of copies which must be made, whether the stack of copy sheets is exhausted or not, etc.

The angular relationship between the original dispensing and collecting trays if shown for illustrative purposes only and is not critical at all.

As the originals are passed from stack 25 to stack 35 and back, the ignition sequence of light sources 31L and 31R remains the same in that firstly the original is exposed by light source 31L. How the same order of the originals in their stack and the collation of the copies are carried out will be explained in the further course of the description.

A feeder as illustrated hereinbefore may be of advantage when the copying apparatus in which it is incorporated works in combination or is linked with a so-called sorter which is a device consisting essentially of a plurality of collecting trays or bins. Each tray has an individually adressable deflecting member at its inlet which member is actuated when a copy has to be deposited into it. Otherwise the copies pass over it. So, if for example, ten copies of a stack of originals are to be made and a sorter having a capacity of say 25 bins is used, then the exposure of said originals will be carried out in sequence, and the ten copies will each be deposited in one of the first ten bins of the sorter. Then, the second original of the stack will undergo the same process and so further on, until all originals are copies ten times. After finishing of the complete cycle, the first ten bins of the sorter will contain a complete set of collated copies which may be removed and forwarded towards a stapling station. As such sorters are well known in the art they need not be further described, as they do not form part of the invention.

In case the feeders as illustrated are intended as feeders for a duplicating apparatus, it is of advantage to dispense each original only once. More particularly, the relative motion between original 25 and light sources 31 will be carried out by keeping the light-sources in standstill while the original performs a to-and-fro motion in front of the light sources. It must be noted however, that precautionary measures have to be taken for not falling out of the field depth of the objectives in order to guarantee a sufficiently sharp image. In addition to rollers and guides 29, 39 supplementary means have to be provided which keep the original in a taut condition over its entire surface (see further).

Figure 2:
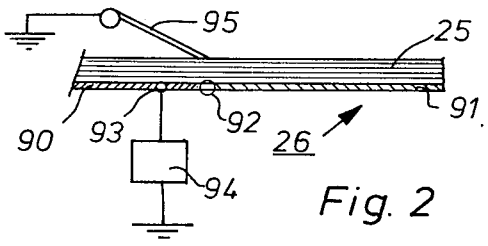
FIG. 2 shows a detail of an original feeder of FIG. 1.

The tray as illustrated as 26 in FIG. 1 may have a dual structure as illustrated in FIG. 2. They comprise a stationary member 90 and a member 91 which is linked to member 90 by a hinge 92.

In fixed member 90 a terminal 93 may be provided which makes contact with pivotal terminal 95 when the stack 25 is completely dispensed. It will be clear that the closing of circuit 93, 94 and 95 may be used for controlling purposes. So, its closing may count down by one the number of copies preset on the copying apparatus, or it may stop the machine, etc.

Copying apparatus according to the invention may thus be so designed that they enable a stack of two-sided originals to be copied for a plurality of times. As a consequence complete sets of duplex copies are delivered into the trays 57.

It will be clear to the skilled worker that stack 25 may contain one-sided originals. In that case, the copying apparatus may be so programmed that one of the light sources 31 (see FIG. 1) corresponding to the side bearing information is energized, while the transfer and fixing stations may continue to function as described above, thereby obtaining one-sided copies of successive one-sided originals.

Figure 3:
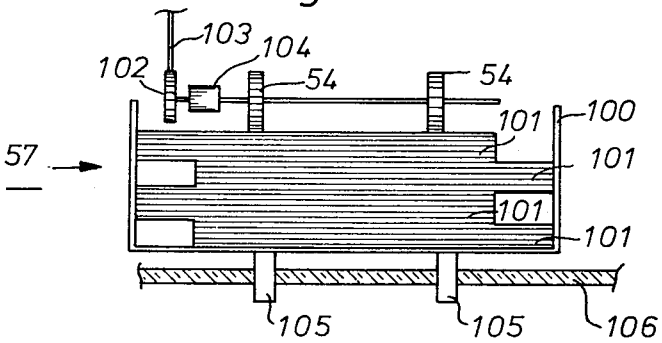
FIG. 3 shows the staggered piling of stacks of copies.

In order to increase the convenience of the apparatus it is of advantage to deliver the sets of copies in such a manner that each individual set is separated with respect to the other ones. A tray 57 with the help of which the foregoing cycle may be carried out is illustrated in FIG. 3. The tray 57 comprises a trough 100, having a width exceeding that of the sets of copies 101 which are deposited by means of a plurality of friction wheels 54 which are driven via belt and pulley drive 102, 103 and friction coupling 104. The belt and pulley drive 102, 103 is constantly energized tending to rotate the friction wheels 54 in such a way that the papers which pass under it are moved over the underlying papers. The friction coupling 104 is so designed that as long as the copy papers are able to slide freely over the underlying ones, this sliding is not hindered. When, however, an obstacle is met the friction coupling 104 will be unable to further drive the paper due to the increased resistance encountered by friction wheels 54. The obstacle may be in the form of an upstanding wall at the end of trough 100 serving for aligning the pages. In order to provide for a visual distinction between the stacks of copies in trough 100, the latter has been provided at its bottom with a pair of elements 105 which have each a bore through which a thread capable of engaging a screw 106 may pass. The screw 106 is driven by suitable motor means (not shown) which rotate for a given time in a given direction after a complete set has been copied. When a second set has been copied, the motor rotates in the opposite direction; after a third set, the screw 106 again rotates in the same sense as during the copying step of the first set, etc. This results in forming a stack of staggered sets of copies 101 in the trough 100 which facilitates their further manipulation to a large extent.

The signal, necessary for starting the motor driving the screw 106, may be generated by closing the contact formed by terminals 93, 95 shown in FIG. 2. It will be clear that, if desired, the closing of this contact may also serve for delivering a sheet of copy paper to the sets of copies 101 which is not used in the copying cycle and which separates the copy sets 101 from each other. In so doing, there is no need to provide a sorter device associated with the copying apparatus.

Figure 4:
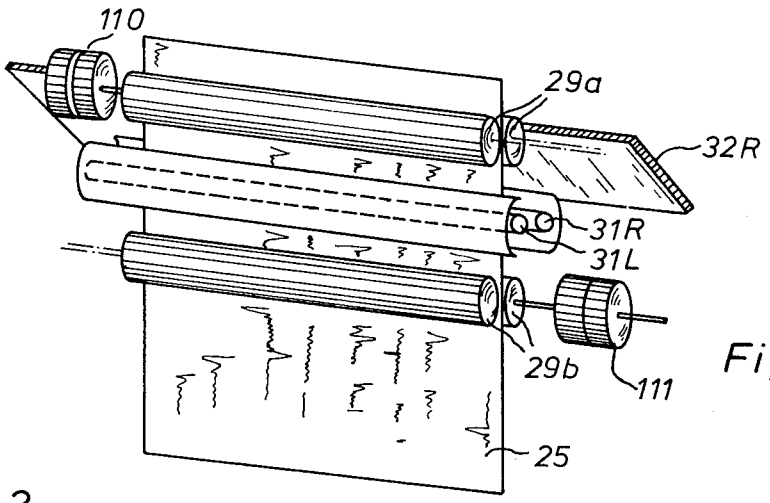
FIG. 4 illustrates how an original is image-wise scanned in an exposure unit according to FIG. 1.

In FIG. 4 a preferred method of scanning an original 25 by the copying apparatus according to the invention is illustrated.

The original 25, when passing in front of light sources 31 and their associated reflectors is illuminated over its entire width, but only over a part of its length. This procedure is applied twice, once for the backside of the original and once for the frontside. Due to the fact that no material support for the original 25 can be provided when the latter is kept by roller pairs **29*a* and 29*b*, an adequate tensioning of the original 25 must be provided for the purpose of not getting out of focus. Therefore, extreme care must be taken that the distance between the surface of the original 25 and the mirror 32 (only one mirror being shown) remains within the depth of field of the associated optical system located downstream in the apparatus. To this end, the roller pairs 29*a* and 29*b* are driven via slip clutches 110 and 111 respectively, which slip clutches 110, 111 are so linked with their respective drive shaft and roller pairs that the one which is connected to the roller pair driving the original is in driving condition, whereas the one which is connected to the roller pair through which the original is pulled exerts a braking action upon the latter. In this manner the original is kept taut and no noticeable distance fluctuations between it and the mirrow 32 occur. In order to avoid that a misalignment of the original 25 between roller pairs 29*a* and 29*b* should occur a supplementary pair of guides (not shown) made of glass or other transparent material may be located between the said roller pairs and light sources 31R and 31L. This pair of transparent guides must lie in the direct line of the other pairs of guides 39 shown in FIG. 1**.

Figure 6:
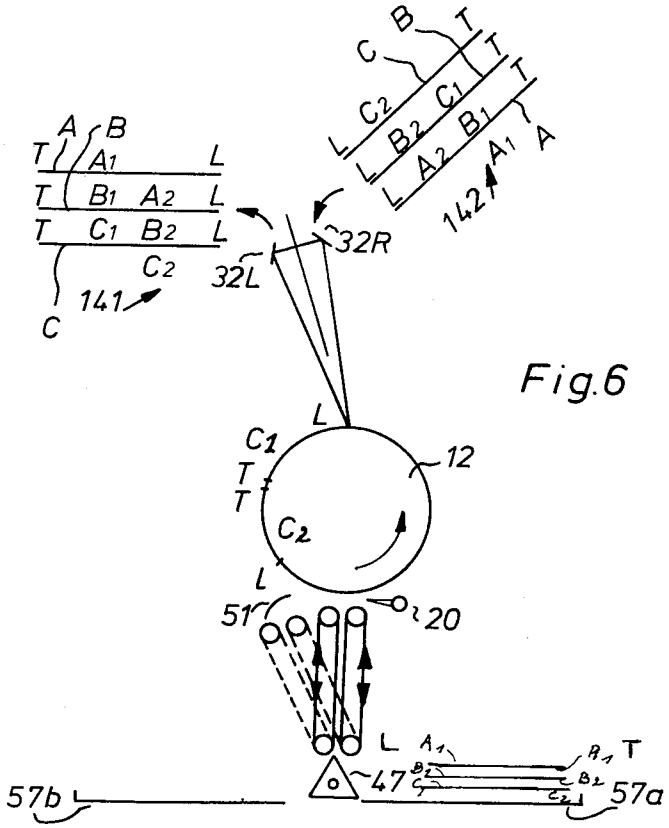
FIGS. 5 and 6 illustrate copying cycles in copying apparatus equipped with automatic feeders such as in FIG. 1.
Figure 5:
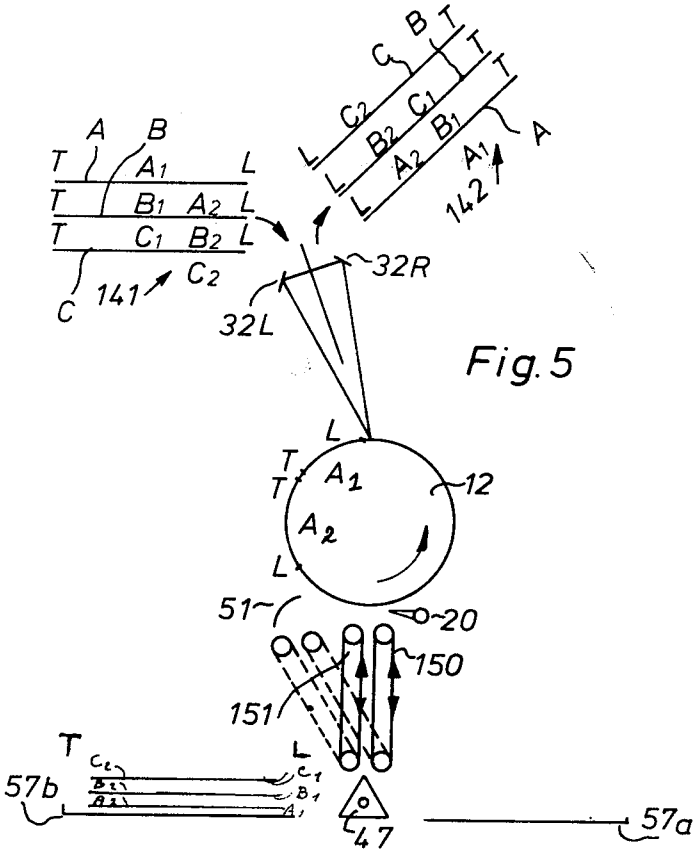

Finally, FIGS. 5 and 6 illustrate schematically how copying cycles with a xerographic duplex copying apparatus 10 according to the invention may be carried out illustrating the feature that no master sheet reversal or recirculative feeding has to be carried out in order to obtain a stack of collated copies.

In FIG. 5 the originals are fed in sequence from tray 141 towards tray 142, whereas in FIG. 6 the reverse situation is illustrated in that the originals are again fed from tray 142 towards tray 141 after already having undergone a first copying cycle.

For clarity's sake, it will be assumed that three originals A, B and C are to be copied and placed in the tray 141 in the sequence as illustrated. The originals have front and back faces which are identified by the index 1 and 2 respectively. The trailing and leading edges of the originals are identified by the characters T and L respectively.

In the copying cycle illustrated in FIG. 5, the originals A, B and C are fed towards the exposure station from which only the light reflecting mirrors 32L and 32R are illustrated. After emerging from the exposure station the originals are fed to the collecting tray 142. As may be derived, the sheet A which had the uppermost position in tray 141 has become the downmost one in tray 142. The relative position of the front and back faces A1, A2, B1, B2, C1 and C2, however, has remained the same.

In the case that original A is exposed, two toner images A2 and A1 are obtained on photoconductive drum 12 after development since the scanning is done via 32L and 32R respectively and consecutively. The relative position of said toner images is such that the one corresponding with the face A2 of the original has a leading edge corresponding with the leading edge of the original. For the toner image corresponding with the face A1 of the original, the situation is reversed in that its leading edge corresponds with the trailing edge of the original.

A sheet of copy paper 41, being fed against the drum contacts the toner image A1 so that the latter is transferred to it. After separation from the drum and subsequent fixing (see FIG. 1) the copy sheet is gripped between endless belts 150 and 151 and via guide 51 fed for a second time against the drum. It will be clear that the second time the edge of the copy sheet which was last separated from the drum 12 will firstly contact the latter for a second transfer and fixing cycle.

After the second transfer and fixing cycle the copy sheets 41, now bearing a transferred and fixed toner image on both sides and in the right order are deposited, after deflection by member 47, in collecting tray **57*b***.

When a plurality of originals A, B and C are copied, their copies collect in tray **57*b* as illustrated in FIG. 5** As may be derived the relative position of neither the originals nor their copies has undergone changes, in that their faces have retained their original position relative to each other.

The copying process illustrated in FIG. 6 is analogous and needs therefore no further description. The main point of difference with the copying cycle described hereinbefore resides in the collecting of copies in tray **57*a*, in a stack, inverted compared to the FIG. 5 case but in the proper page sequence. The second collecting tray 57*a* is necessary, in that when not provided, inversely collated copies would be collected when using tray 57*b* alone. Re-feeding of originals from tray 142 to 141 results in a collated position of the originals such as they were arranged at the start of the first copying cycle. The originals are, however, also accessible in tray 142** when only one copy is desired.

It will be clear that collecting tray 57*a* and 57*b* are not necessarily located at the bottom of the housing of the copying apparatus 10, but that they may be provided at an other location where the stacks of collated copies may easily be taken by the operator of the apparatus.

The apparatus according to the invention enables different copying modes to be realized.

It will be clear from the foregoing description that the apparatus is suited for single-pass duplex/duplex copying in that an original bearing information on both sides may be copied in such a way that the copy sheet is a one-sheet reproduction of it. In case an original bearing information on only one side of it is presented for exposure, the complete copying cycle (duplex scanning and processing) will result in a copy sheet which will have the same aspect.

As the latter method is time consuming in that it requires a dual exposure of the original (once for each side of it) and a subsequent dual processing (transfer, and fixing) for the copy sheet, the necessary provisions may be made such that when a stack of single-sided originals are to be copied, the apparatus will throw the single sided copies directly into the collecting tray. In so doing, the second transfer and fixing step of a "white" or colourless toner image is not carried out.

It may also be of interest, for the purpose of economy in copy paper consumption to also provide the possibility for a third mode of operation, namely that from a stack of single sided originals, duplex copies may be realized. This feature reduces the copy paper consumption to almost one half, because the information contained in or on two originals will appear in the form of one double sided copy. This mode of operation may be realized by firstly forming a toner image of the information borne by the first original, say A1 of FIG. 5, and transferring and fixing it on the second side of the copy paper. While the feeder handles originals as in the duplex-duplex case, the copy paper is kept at a standstill between the endless belts 150 and 151 until the toner image of the information borne by a second single sided original is ready for transfer. Then said second transfer and consequent fixing step is carried out on the residual face of the copy paper. It is to be noted that here, the use of trays 57*a* and 57*b* has to be inverted compared to the duplex-duplex case.

When, however, an uneven number of originals is to be copied, the second transfer and fixing step does not occur. Therefore, a time mechanism must be provided in order to throw the copy sheet in the course of being copied out of the apparatus when a predetermined time lapse has passed before a next copying cycle is started. In so doing, the copying cycle for a complete set of single sided originals may be stopped without the chance that the last copy is missing.

It will also be clear that instead of being used in the field of xerography, the apparatus may also be adapted to be used in the electrostatographic field in which an electrostatic charge is imagewise deposited on a dielectric drum. The aim of the invention is to include also such systems and devices.

We claim:

1. In a xerographic copying apparatus including an image projection station adapted to successively project images of matter appearing on the opposite sides of master sheets fed thereto; image forming means including a photoconductive member for recording the images successively projected from said projection station and for forming on said member transferable reproductions of said image; transfer and fixing means for transferring the thus-formed image reproduction in order onto opposite surfaces of copy sheets brought into image-receiving relationship with said member and for fixing the thus-transferred reproductions to said opposite sheet sides; and means for conditioning the photoconductive member for recording fresh images, in combination, the improvement comprising:

a master feeding station in which the master sheets to be reproduced are arranged in an original order in a stack, a master sheet collecting station for receiving and collecting master sheets in a stack in the order delivered thereto, a first cyclically operating master sheet handling mechanism for feeding said master sheets from said stack at said master feeding station one by one in succession to said image projection station for a first projection in succession of images of the matter appearing on its opposite sides and thence after said first projection to said master sheet collection station, to be collected in a stack in an order reversed from said original order, a second cyclically operating master sheet handling mechanism for feeding master sheets one by one from said stack at said master sheet collecting station in said reverse order to said image projection station for a second projection in succession of the matter appearing on the opposite sides of said master sheets and thence back to said master sheet feeding station for stacking in said original order, at least one copy sheet supply station for holding a plurality of copy sheets in a stack, first and second copy sheet collecting stations for receiving and collecting copy sheets bearing the reproductions of said master sheets formed during said first and second projections, respectively, and cyclically operating copy sheet delivery mechanism for removing copy sheets one by one from said stack at said supply station and for bringing the opposite sides of each thus removed sheet in succession into image receiving relationship with said photoconductive member to permit successive transfer of the reproduction thereto from the latter and for delivering to said respective first and second copy sheet collecting stations copy sheets carrying said reproductions corresponding with said first and second projections.

2. Apparatus according to claim 1, having a cycling control mechanism for repeating a complete copying operation a plurality of times to produce a plurality of copies of a given master before the next master is copied.

3. Apparatus according to claim 1, wherein said photoconductive element has different areas for receiving projection images of matter appearing on the opposed sides of a master sheet during one cycle of the first and second master sheet handling mechanisms, and means for synchronizing the operations of feeding a master sheet to the image projection station, projecting a pair of images to the photoconductive recording element, transferring the recorded images to opposite sides of a copy sheet and conditioning of the photoconductive element, to occur once for each cycle of the copy sheet handling mechanisms.

4. Apparatus according to claim 1, including image projection means which is adapted to scan matter to be copied as the master sheet bearing such matter moves through said image projection station.

5. Apparatus according to claim 1, wherein images of matter on opposite sides of a duplex master sheet are projected in sequence and wherein the photoconductive element is displaced during such image projection phases so as to bring the different recording areas thereof successively into image-receiving position.

6. Apparatus according to claim 5, wherein the projection means serves progressively to project an image of the matter on one side of a master sheet on to the photoconductive element during displacement of the master sheet in one direction, and the master sheet handling systems then cause a reverse displacement of such sheet and the projection means serves progressively to project an image of the matter on the opposite side of such sheet during that reverse movement.

7. Apparatus according to claim 6, wherein said projection station includes an optical projection system incorporating at least one objective which serves in the projection of images from both sides of a duplex master sheet, the objective being movable automatically from one operative position to another in timed relation and means for successively illuminating first one and then the opposite sides of a duplex master sheet in correspondence with the operative position of said objective.

8. Apparatus according to claim 1, wherein said image-forming means includes means for overall electrostatically charging the recording areas of the photoconductive element and developing the electrostatic images resulting from the image-wise irradiation of such areas with light from the projection station, and wherein the transfer means causes image-wise transfer of the thus developed image from the photoconductive element to the copy sheet.

9. Apparatus according to claim 1 and incorporating a supplementary projection station for copying two pages of an open book, the apparatus having a scanning projection system for progressively projecting images of the two book pages during one copying cycle.

10. Apparatus according to claim 1 and including means causing successive duplex copies or successive sets of duplex copies to collect at the first or second collecting locations in staggered relationship.

* * * * *